US010551045B2

(12) United States Patent
Xie

(10) Patent No.: US 10,551,045 B2
(45) Date of Patent: Feb. 4, 2020

(54) LED LIGHT STRING CONTROL SYSTEM AND METHOD

(71) Applicant: Dongguan Rongsheng Electronic Industrial Co., Ltd., Dongguan, Guangdong (CN)

(72) Inventor: Huarong Xie, Guangdong (CN)

(73) Assignee: Dongguan Rongsheng Electronic Industrial Co., Ltd., Dongguan (CN)

( * ) Notice: Subject to any disclaimer, the term of this patent is extended or adjusted under 35 U.S.C. 154(b) by 77 days.

(21) Appl. No.: 15/871,816

(22) Filed: Jan. 15, 2018

(65) Prior Publication Data

US 2019/0186724 A1 Jun. 20, 2019

(30) Foreign Application Priority Data

Dec. 14, 2017 (CN) ..... 2017 1 1336575

(51) Int. Cl.
*F21V 21/00* (2006.01)
*F21V 23/00* (2015.01)
*H05B 33/08* (2006.01)

(52) U.S. Cl.
CPC ..... *F21V 23/001* (2013.01); *H05B 33/0806* (2013.01); *H05B 33/0842* (2013.01)

(58) Field of Classification Search
CPC ..... F21V 23/001; H05B 33/0842; H05B 33/0806
See application file for complete search history.

(56) References Cited

U.S. PATENT DOCUMENTS

2012/0086349 A1* 4/2012 Segan ..... H05B 33/0803 315/187
2014/0239814 A1* 8/2014 Pan ..... H05B 33/0809 315/114
2015/0061503 A1* 3/2015 Billard ..... H05B 37/0272 315/149
2017/0245336 A1* 8/2017 Li ..... H05B 33/0845

* cited by examiner

*Primary Examiner* — Ali Alavi

(57) ABSTRACT

The present application discloses an LED light string control system, which comprises a direct-current power supply, a polarity change control unit and a forward-reverse connection LED light string circuit, wherein the direct-current power supply is electrically connected with the polarity change control unit, and the polarity change control unit is electrically connected with the forward-reverse connection LED light string circuit. The present application further discloses an LED light string control method, which comprises: a polarity change control unit outputs a changed-polarity voltage with a specific frequency according to a timing sequence; and LED lamps with the corresponding polarity in a forward-reverse connection LED light string circuit are lighted according to the polarity-changed voltage.

10 Claims, 7 Drawing Sheets

LED LIGHT STRING CONTROL SYSTEM AND METHOD

CROSS-REFERENCE TO RELATED APPLICATION

This application is based upon and claims priority to Chinese Patent Application No. 201711336575.0, filed on Dec. 14, 2017, the entire contents of which are incorporated herein by reference.

TECHNICAL FIELD

The present disclosure relates to the technical field of LED lamp control, and in particular to a three-wire LED light string control system and method.

BACKGROUND

New light source is playing an important role in low-carbon economy, and LED illumination is regarded as one of the most prospective high and new technologies in the future and has become the key field of nationally implemented energy conservation and emission reduction, green and environmental protection and low-carbon illumination. Some domestic and international major companies specialized in illumination appliance development have invested heavily in highlight LED research and development, thereby bringing great opportunities and challenges to the new light source and the green illumination manufacturing industry.

With the development of LED control techniques, LED lamps and light strings are not only applied to decoration of various festivals, such as Christmas and the like, but also applied to home decoration, city lighting engineering and various entertainment venues. Compared with the traditional incandescent light strip, the LED light string has incomparable advantages: energy consumption is low, colors are beautiful, and full color change and lighting and decorating functions may be achieved by controlling three primary colors or color brightness (chromaticity), thereby improving festival atmosphere. Therefore, more and more LED lamps and LED light strings will be applied to the daily life of people. Development of the illumination manufacturing industry also needs to follow the international trend of low-carbon life and energy conservation and emission reduction, but currently, a number of lamps and light strings have defects of high energy consumption and costs.

The existing multi-path LED light string control circuits have high costs, for example, usually five wires are used to achieve control effects of a multi-path composite parallel-connection circuit, thereby causing too high production costs and relatively higher energy consumption.

SUMMARY

A technical problem to be solved by the present disclosure is to provide an LED light string control system and method by aiming at problems that the existing composite parallel-connection LED light string circuit has high costs and energy consumption, wherein a polarity change control unit is configured, and the polarity change control unit outputs a specific-changed-polarity voltage to a three-wire forward-reverse connection LED light string circuit according to a timing sequence instruction, so as to light LED lamps with the corresponding polarity; therefore, the traditional five-wire LED light string circuit may be replaced, and production costs are largely reduced; and when sweep frequency for the changed polarity according to the timing sequence is larger than 24 Hz, that is, LED lamps with all polarities are lighted at the same time, a decorative effect is achieved.

According to the first aspect, an LED light string control system is provided, which comprises a direct-current power supply, wherein the LED light string control system further comprises a polarity change control unit and a forward-reverse connection LED light string circuit, the direct-current power supply is electrically connected with the polarity change control unit, and the polarity change control unit is electrically connected with the forward-reverse connection LED light string circuit.

In particular, the direct-current power supply is used for providing direct-current voltage for the LED light string control system; and the polarity change control unit is used for outputting a changed-polarity voltage with a specific frequency to the forward-reverse connection LED light string circuit according to a timing sequence, wherein the polarity change control unit is a three-wire polarity change control unit.

With reference to the first aspect of the present disclosure and in a first possible implementation manner, three output ports are arranged at the three-wire polarity change control unit and are respectively electrically connected with three input ends of the forward-reverse connection LED light string circuit, and the three input ports respectively are a first input port, a second input port and a third input port.

With reference to the first possible implementation manner of the first aspect of the present disclosure and in a second possible implementation manner, the three-wire polarity change control unit comprises a control module, a processing module, a power management module and an output port module, the processing module is respectively electrically connected with the control module, the power management module and the output port module, and the output port module is electrically connected with the three output ports of the three-wire polarity change control unit.

With reference to the first aspect of the present disclosure and in a third possible implementation manner, the forward-reverse connection LED light string circuit is any one of three-path, four-path, five-path and six-path forward-reverse connection LED light string circuits, the three input ports of the forward-reverse connection LED light string circuit respectively are the first input port, the second input port and the third input port, and corresponding wires of the three input ports respectively are a wire A, a wire B and a wire C.

With reference to the third possible implementation manner of the first aspect of the present disclosure and in a fourth possible implementation manner, the forward-reverse connection LED light string circuit comprises a first diode L1, a second diode L2 and a third diode L3, wherein the polarity of the first diode L1 is opposite to the polarity of the second diode L2, the first diode L1 and the second diode L2 are in parallel connection between any two of the wire A, the wire B and the wire C, and a combination of any two wires in parallel connection with the third diode L3 is different from a combination of any two wires in parallel connection with the first diode L1 and the second diode L2; or the forward-reverse connection LED light string circuit comprises a first diode L1, a second diode L2, a third diode L3 and a fourth diode L4, wherein the polarity of the first diode L1 is opposite to the polarity of the second diode L2, the polarity of the third diode L3 is opposite to the polarity of the fourth diode L4, the first diode L1 and the second diode L2 are in parallel connection between any two of the wire A, the wire B and the wire C, and a combination of any two wires in parallel connection with the third diode L3 and the fourth diode L4 is different from a combination of any two wires in parallel connection with the first diode L1 and the second diode L2; or the forward-reverse connection LED light string circuit comprises a first diode L1, a second diode L2, a third diode L3, a fourth diode L4 and a fifth diode L5, wherein the polarity of the first diode L1 is opposite to the polarity of the second diode L2, the polarity of the third diode L3 is opposite to the polarity of the fourth diode L4, the first diode L1 and the second diode L2 are in parallel connection between any two of the wire A, the wire B and the wire C, and a combination of any two wires in parallel connection with the third diode L3 and the fourth diode L4 is different from a combination of any two wires in parallel connection with the first diode L1 and the second diode L2 and a combination of any two wires in parallel connection with the fifth diode L5; or the forward-reverse connection LED light string circuit comprises a first diode L1, a second diode L2, a third diode L3, a fourth diode L4, a fifth diode L5 and a sixth diode L6, wherein the polarity of the first diode L1 is opposite to the polarity of the second diode L2, the polarity of the third diode L3 is opposite to the polarity of the fourth diode L4, the polarity of the fifth diode L5 is opposite to the polarity of the sixth diode L6, the first diode L1 and the second diode L2 are in parallel connection between any two of the wire A, the wire B and the wire C, and a combination of any two wires in parallel connection with the third diode L3 and the fourth diode L4 is different from a combination of any two wires in parallel connection with the first diode L1 and the second diode L2 and a combination of any two wires in parallel connection with the fifth diode L5 and the sixth diode L6.

With reference to the first aspect of the present disclosure and in a fifth possible implementation manner, the specific frequency is 24 Hz.

According to a second aspect, an LED light string control method is provided, which comprises:

a polarity change control unit outputs a changed-polarity voltage with a specific frequency according to a timing sequence; and according to the polarity-changed voltage, LED lamps with the corresponding polarity in a forward-reverse connection LED light string circuit are lighted.

With reference to the second aspect of the present disclosure and in the first possible implementation manner, the step that a polarity change control unit outputs a changed-polarity voltage with a specific frequency according to a timing sequence comprises:

a control module inputs a control instruction of a polarity-changed voltage with a specific frequency into a processing module in advance; and the processing module controls an output port module to process inputted power supply voltage to obtain a group of specific-polarity voltages and respectively transmits the voltages to the arranged three output ports.

With reference to the second aspect of the present disclosure and in the second possible implementation manner, before the step that a polarity change control unit outputs a changed-polarity voltage with a specific frequency according to a timing sequence, the method further comprises a step that a direct-current power supply provides power for the polarity change control unit.

With reference to the second aspect of the present disclosure and in the third possible implementation manner, the specific frequency is 24 Hz.

According to the LED light string control system and method provided by the present disclosure, the polarity change control unit is configured, and the polarity change control unit outputs the specific-changed-polarity voltage to the three-wire forward-reverse connection LED light string circuit according to the timing sequence instruction, so as to light LED lamps with the corresponding polarity; therefore, the traditional five-wire LED light string circuit may be replaced, and production costs are largely reduced; and when sweep frequency for the changed polarity according to the timing sequence is larger than 24 Hz, that is, LED lamps with all polarities are lighted at the same time, a decorative effect is achieved.

BRIEF DESCRIPTION OF THE DRAWINGS

In order to more clearly illustrate the technical solutions of the embodiments of the present disclosure, the following drawings will be briefly described in connection with the embodiments, and it will be obvious that the drawings in the following description are only some of the present disclosure and it will be apparent to those skilled in the art that other drawings may be obtained without departing from the scope of the inventive work in accordance with these drawings.

Figure 1:
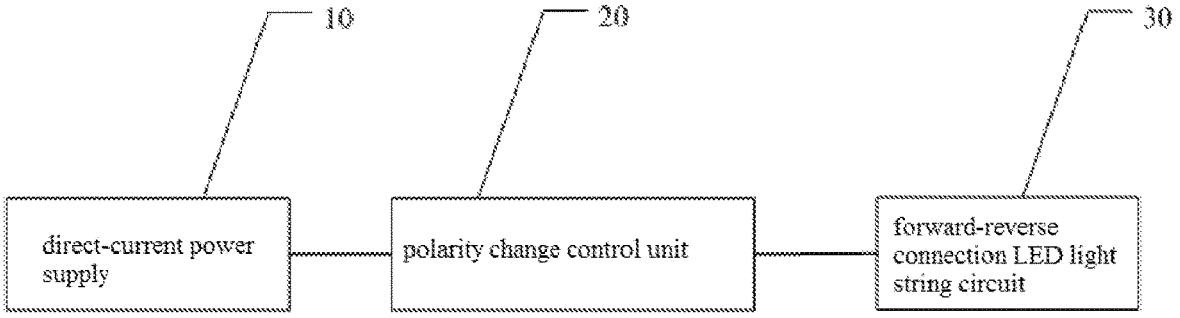
FIG. 1 is a schematic diagram of logic assembly connection of an embodiment of an LED light string control system provided by the present disclosure.

In the drawings, numeric symbols are as follows: 10—direct-current power supply; 20—polarity change control unit; 21—control module; 22—processing module; 23—output port module; port a—first output port; port b—second output port; port c—third output port; 30—forward-reverse connection LED light string circuit; port A—first input port; port B—second input port; and port C—third input port.

DESCRIPTION OF THE EMBODIMENTS

To make the purpose, technical scheme and advantages of the disclosure more clearly understood, the disclosure is described in further detail below in conjunction with accompanying drawings and embodiments. It should be understood that the specific embodiments described below are merely to illustrate, but to limit, the disclosure.

Example of a System

The present disclosure provides an LED light string control system, referring to FIG. 1, wherein FIG. 1 is a schematic diagram of logic assembly connection of an embodiment of an LED light string control system provided by the present disclosure. The LED light string control system comprises a direct-current power supply 10, a polarity change control unit 20 and a forward-reverse connection LED light string circuit, wherein the direct-current power supply 10 is electrically connected with the polarity change control unit 20, and the polarity change control unit 20 is electrically connected with the forward-reverse connection LED light string circuit. The polarity change control unit 20 is configured to output a specific-changed-polarity voltage to a three-wire forward-reverse connection LED light string circuit, so as to light LED lamps with the corresponding polarity; therefore, the traditional five-wire LED light string circuit may be replaced, and production costs are largely reduced; and when sweep frequency for the changed polarity according to the timing sequence is larger than 24 Hz, that is, LED lamps with all polarities are lighted at the same time, a decorative effect is achieved.

Specifically, the direct-current power supply 10 is used for providing direct-current voltage for the LED light string control system; and the polarity change control unit 20 is used for outputting a changed-polarity voltage with a specific frequency to the forward-reverse connection LED light string circuit according to a timing sequence, so as to light LED lamps with the corresponding polarity in the forward-reverse connection LED light string circuit.

Figure 2:
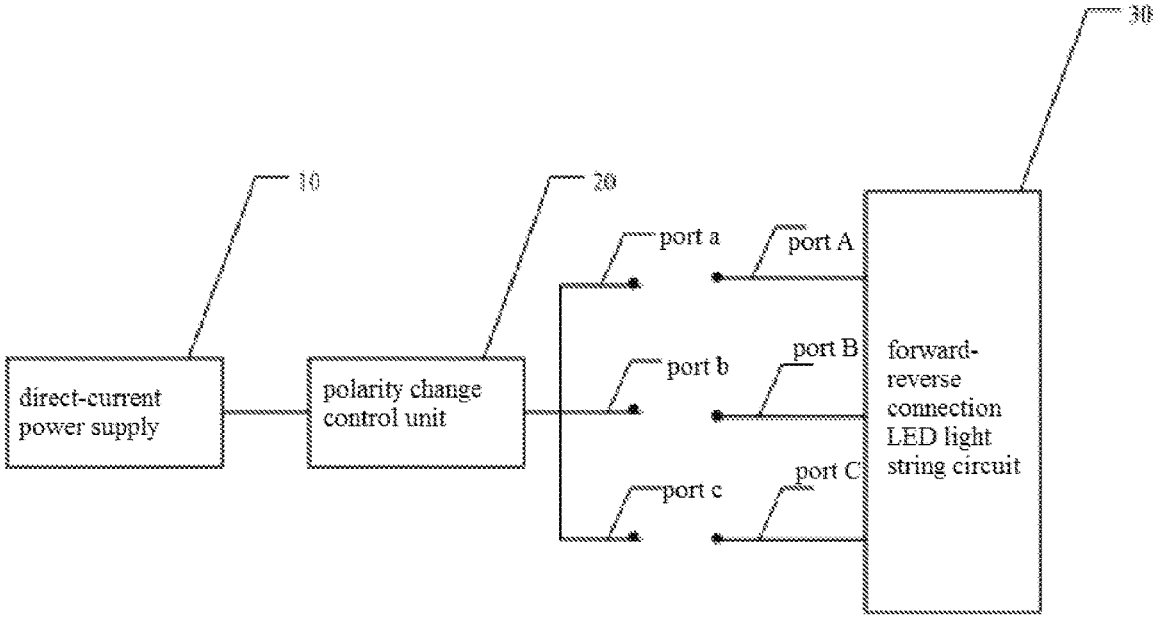
FIG. 2 is a schematic diagram of an embodiment of input port and output port connection in an embodiment of the LED light string control system provided by the present disclosure.

Furthermore, referring to FIG. 2, FIG. 2 is a schematic diagram of an embodiment of input port and output port connection in an embodiment of the LED light string control system provided by the present disclosure. The polarity change control unit 20 is a three-wire polarity change control unit 20, three output ports are arranged at the three-wire polarity change control unit 20 and respectively are a port a, a port b and a port c, the three output ports are respectively electrically connected with three input ports of the forward-reverse connection LED light string circuit, and the three input ports respectively are a first input port, a second input port and a third input port. It is supposed that the first input port, the second input port and the third input port respectively are a port A, a port B and a port C, and wires in the forward-reverse connection LED light string circuit corresponding to the ports respectively are a wire A, a wire B and a wire C.

It should be illustrated that: first, second and third in the embodiment of the present disclosure are not used for expressing a mounting or electrically transmitting sequence of components, but are merely used for distinguishing each component. A− expresses a negative polarity of a changed-polarity voltage inputted into a port A, A+ expresses a positive polarity of the changed-polarity voltage inputted into the port A, and similar expressions of other ports are in the same way.

Figure 3:
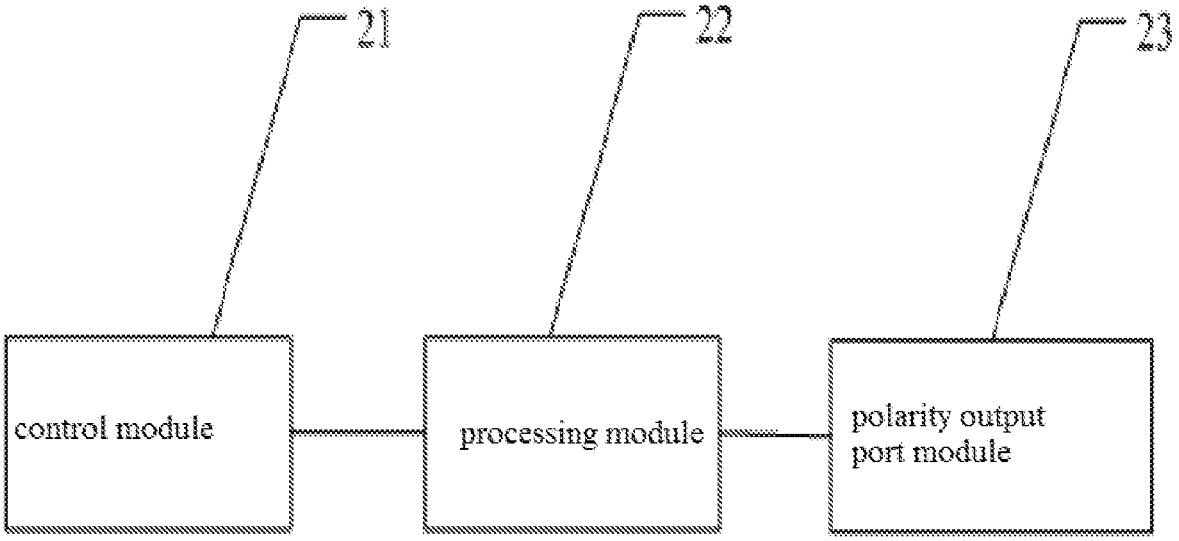
FIG. 3 is a schematic diagram of logic assembly connection of an embodiment of a three-wire polarity change control unit in the LED light string control system provided by the present disclosure.

Furthermore, referring to FIG. 3, FIG. 3 is a schematic diagram of logic assembly connection of an embodiment of a three-wire polarity change control unit 20 in the LED light string control system provided by the present disclosure. The three-wire polarity change control unit 20 comprises a control module 21, a processing module 22, a power management module and an output port module 23, the processing module 22 is respectively electrically connected with the control module 21, the power management module and the output port module 23, and the output port module 23 is electrically connected with the three output ports of the three-wire polarity change control unit 20.

Specifically, the processing module 22 is used for processing requests of the control module 21 and the output port module 23 and outputting a control instruction, the processing procedure comprises specific processing: receiving specific control and timing sequence instructions transmitted by the control module 21 according to written programs, controlling the output port module 23 to increase a voltage to be outputted and the like, so as to meet requirements on outputting a specific-polarity voltage.

Furthermore, the forward-reverse connection LED light string circuit is any one of three-path, four-path, five-path and six-path forward-reverse connection LED light string circuits.

Figure 4:
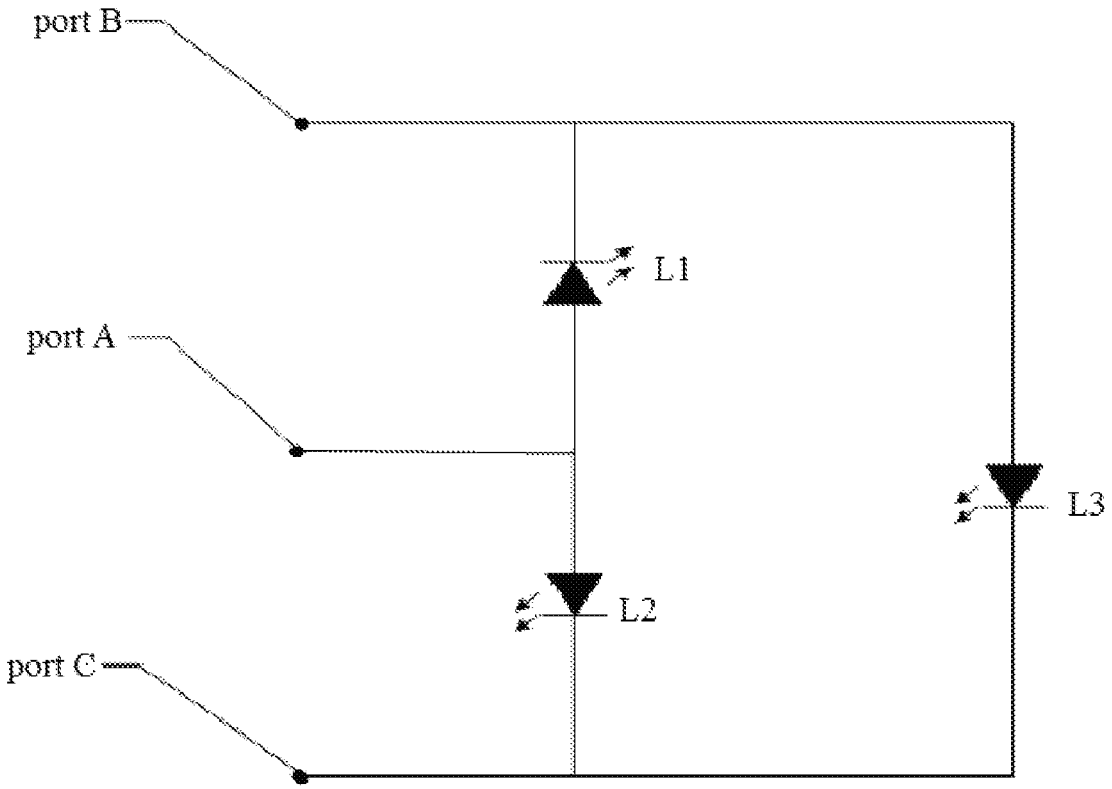
FIG. 4 is a schematic diagram of a first embodiment of assembly and connection of a three-path forward-reverse connection LED light string circuit in an embodiment of the LED light string control system provided by the present disclosure.
Figure 5:
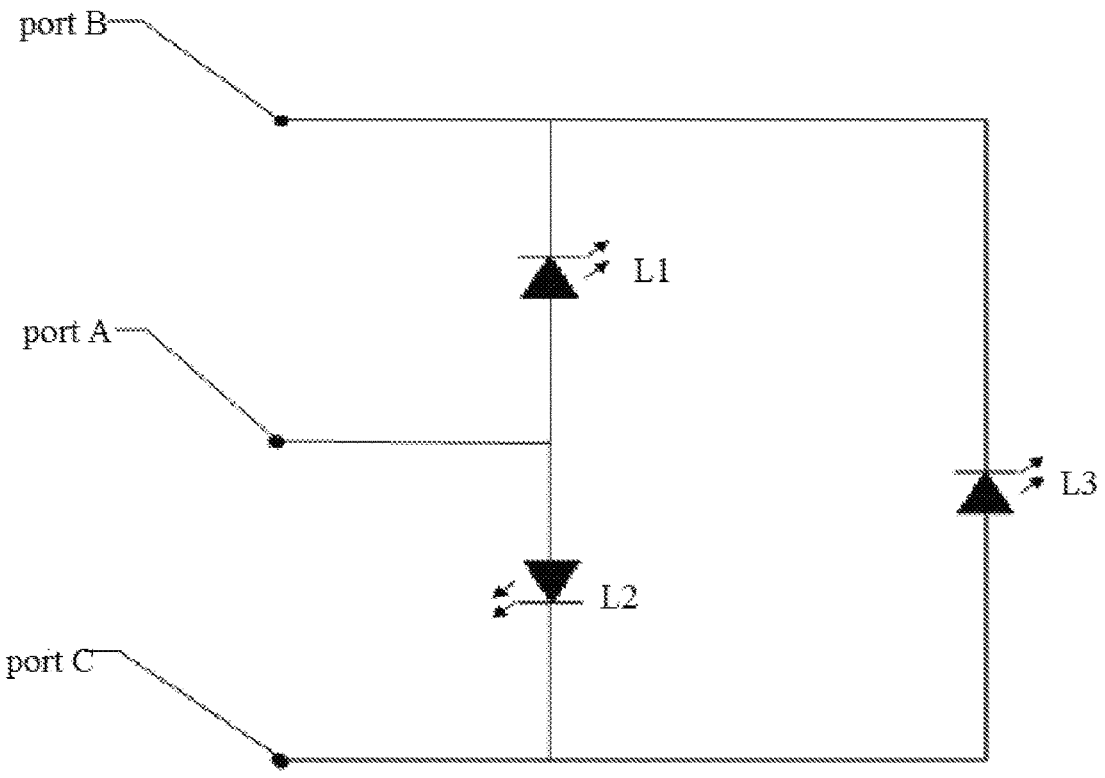
FIG. 5 is a schematic diagram of a second embodiment of assembly and connection of a three-path forward-reverse connection LED light string circuit in an embodiment of the LED light string control system provided by the present disclosure.

Furthermore, as shown in FIG. 4 and FIG. 5, FIG. 4 is a schematic diagram of a first embodiment of assembly and connection of a three-path forward-reverse connection LED light string circuit in an embodiment of the LED light string control system provided by the present disclosure, FIG. 5 is a schematic diagram of a second embodiment of assembly and connection of a three-path forward-reverse connection LED light string circuit in an embodiment of the LED light string control system provided by the present disclosure, and when the forward-reverse connection LED light string circuit is a three-path forward-reverse connection LED light string circuit, a structure assembly and connection manner of the forward-reverse connection LED light string circuit is as follows:

the forward-reverse connection LED light string circuit comprises a first diode L1, a second diode L2 and a third diode L3, wherein the polarity of the first diode L1 is opposite to the polarity of the second diode L2, the first diode L1 and the second diode L2 are in parallel connection between any two of the wire A, the wire B and the wire C, and a combination of any two wires in parallel connection with the third diode L3 is different from a combination of any two wires in parallel connection with the first diode L1 and the second diode L2; specifically, the first diode L1 and the second diode L2 are in parallel connection between the wire A and the wire B, or between the wire A and the wire C, or between the wire B and the wire C, the combination of any two wires in parallel connection with the third diode L3 is different from the combination of any two wires in parallel connection with the first diode L1 and the second diode L2, and the polarity of the third diode L3 is the same as any one of the polarity of the first diode L1 and the polarity of the second diode L2.

The output port module 23 in the polarity change control unit 20 is respectively connected with the port A, the port B and the port C in the forward-reverse connection LED light string circuit, and outputs a changed-polarity voltage with the specific frequency to each port in the forward-reverse connection LED light string circuit according to a timing sequence, so as to light LED lamps with the corresponding polarity; specifically:

when A+ and B−, L1 lights;

when A+ and C−, L2 lights;

when B− and C+, L3 in FIG. 5 lights; and when B+ and C−, L3 in FIG. 4 lights.

Figure 6:
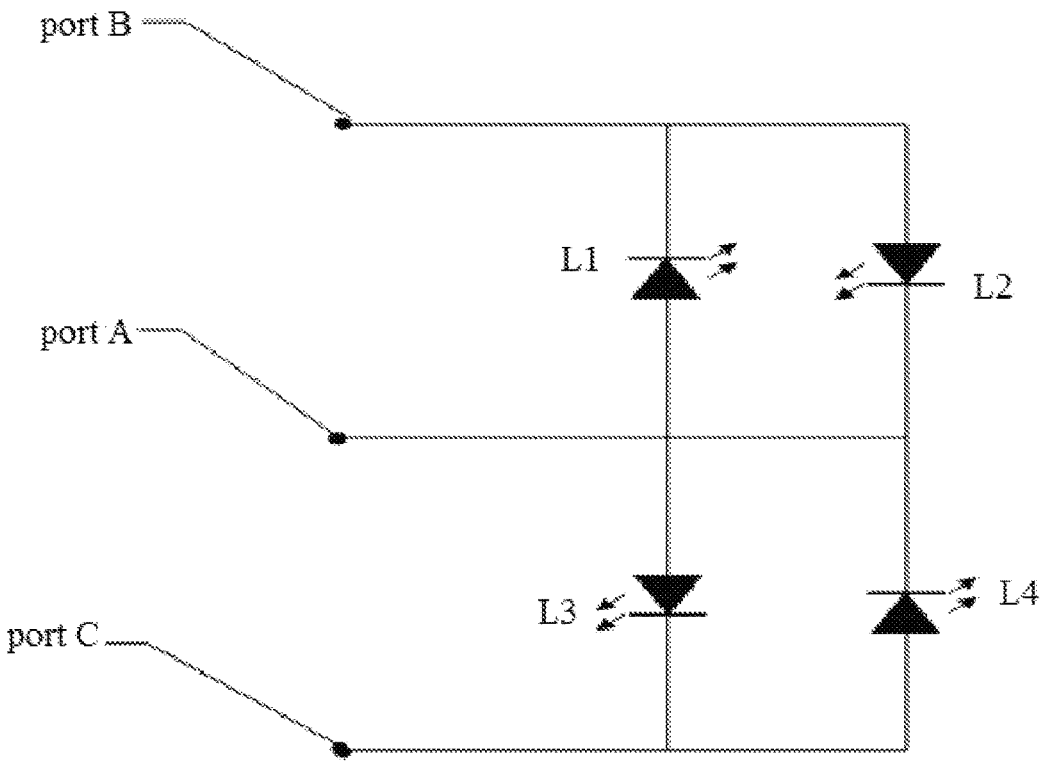
FIG. 6 is a schematic diagram of assembly and connection of a four-path forward-reverse connection LED light string circuit in an embodiment of the LED light string control system provided by the present disclosure.

Furthermore, as shown in FIG. 6, FIG. 6 is a schematic diagram of assembly and connection of a four-path forward-reverse connection LED light string circuit in an embodiment of the LED light string control system provided by the present disclosure, and when the forward-reverse connection LED light string circuit is a four-path forward-reverse connection LED light string circuit, a structure assembly and connection manner of the forward-reverse connection LED light string circuit is as follows:

the forward-reverse connection LED light string circuit comprises a first diode L1, a second diode L2, a third diode L3 and a fourth diode L4, wherein the polarity of the first diode L1 is opposite to the polarity of the second diode L2, the polarity of the third diode L3 is opposite to the polarity of the fourth diode L4, the first diode L1 and the second diode L2 are in parallel connection between any two of the wire A, the wire B and the wire C, and a combination of any two wires in parallel connection with the third diode L3 and the fourth diode L4 is different from a combination of any two wires in parallel connection with the first diode L1 and the second diode L2; and a lighting manner of the four-path forward-reverse connection LED light string circuit is as follows:

when A− and B+, L2 lights;

when A+ and B−, L1 lights;

when A+ and C−, L3 lights; and when A− and C+, L4 lights.

Figure 7:
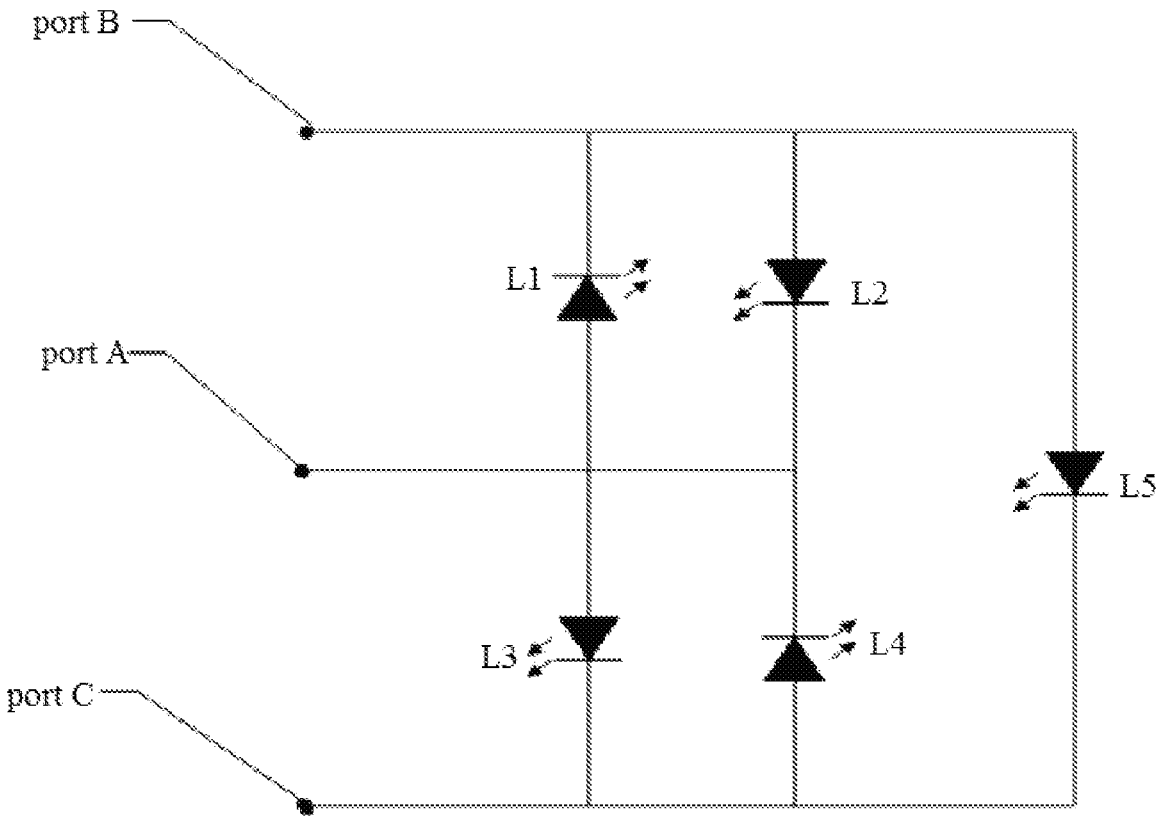
FIG. 7 is a schematic diagram of a first embodiment of assembly and connection of a five-path forward-reverse connection LED light string circuit in an embodiment of the LED light string control system provided by the present disclosure.
Figure 8:
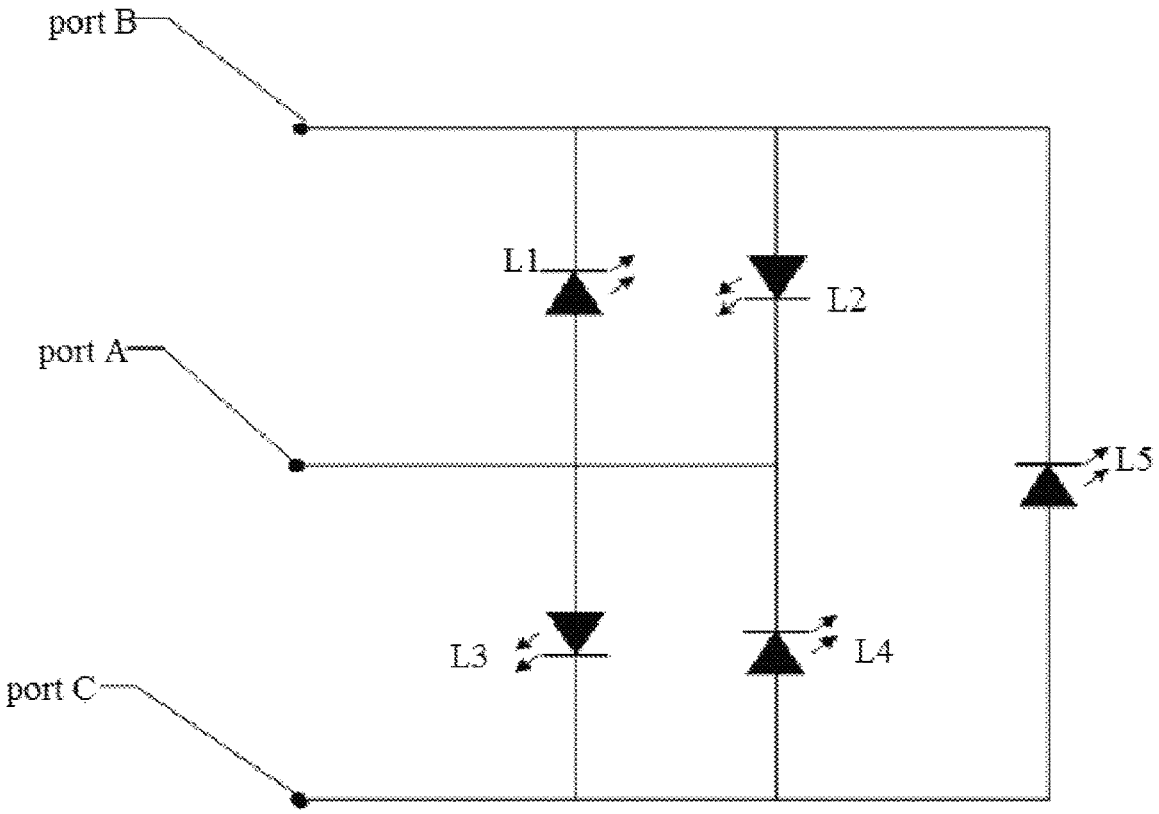
FIG. 8 is a schematic diagram of a second embodiment of assembly and connection of a five-path forward-reverse connection LED light string circuit in an embodiment of the LED light string control system provided by the present disclosure.

Furthermore, as shown in FIG. 7 and FIG. 8, FIG. 7 is a schematic diagram of a first embodiment of assembly and connection of a five-path forward-reverse connection LED light string circuit in an embodiment of the LED light string control system provided by the present disclosure, FIG. 8 is a schematic diagram of a second embodiment of assembly and connection of a five-path forward-reverse connection LED light string circuit in an embodiment of the LED light string control system provided by the present disclosure, and when the forward-reverse connection LED light string circuit is a five-path forward-reverse connection LED light string circuit, a structure assembly and connection manner of the forward-reverse connection LED light string circuit is as follows:

the forward-reverse connection LED light string circuit comprises a first diode L1, a second diode L2, a third diode L3, a fourth diode L4 and a fifth diode L5, wherein the polarity of the first diode L1 is opposite to the polarity of the second diode L2, the polarity of the third diode L3 is opposite to the polarity of the fourth diode L4, the first diode L1 and the second diode L2 are in parallel connection between any two of the wire A, the wire B and the wire C, and a combination of any two wires in parallel connection with the third diode L3 and the fourth diode L4 is different from a combination of any two wires in parallel connection with the first diode L1 and the second diode L2 and a combination of any two wires in parallel connection with the fifth diode L5; and a lighting manner of the five-path forward-reverse connection LED light string circuit is as follows:

when A− and B+, L2 lights;

when A+ and B−, L1 lights;

when A+ and C−, L3 lights;

when A− and C+, L4 lights;

when B− and C+, L5 in FIG. 8 lights; and when B+ and C−, L5 in FIG. 7 lights.

Figure 9:
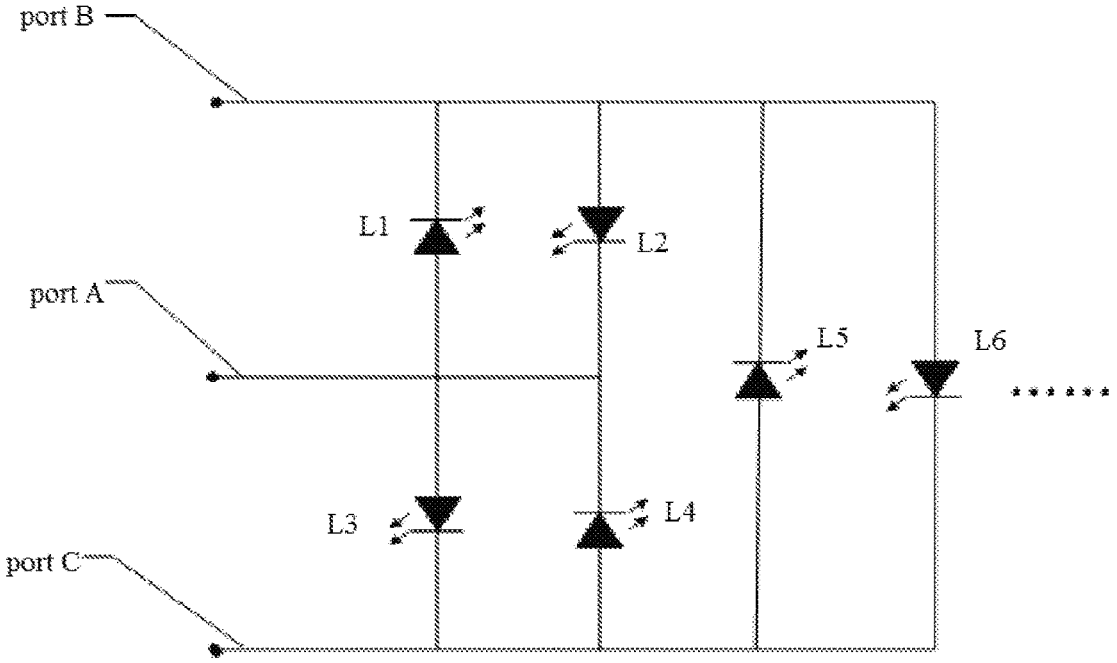
FIG. 9 is a schematic diagram of assembly and connection of a six-path forward-reverse connection LED light string circuit in an embodiment of the LED light string control system provided by the present disclosure.

Furthermore, as shown in FIG. 9, FIG. 9 is a schematic diagram of assembly and connection of a six-path forward-reverse connection LED light string circuit in an embodiment of the LED light string control system provided by the present disclosure, and when the forward-reverse connection LED light string circuit is a six-path forward-reverse connection LED light string circuit or a multi-path forward-reverse connection LED light string circuit, a structure assembly and connection manner of the forward-reverse connection LED light string circuit is as follows:

the forward-reverse connection LED light string circuit comprises a first diode L1, a second diode L2, a third diode L3, a fourth diode L4, a fifth diode L5 and a sixth diode L6, wherein the polarity of the first diode L1 is opposite to the polarity of the second diode L2, the polarity of the third diode L3 is opposite to the polarity of the fourth diode L4, the polarity of the fifth diode L5 is opposite to the polarity of the sixth diode L6, the first diode L1 and the second diode L2 are in parallel connection between any two of the wire A, the wire B and the wire C, and a combination of any two wires in parallel connection with the third diode L3 and the fourth diode L4 is different from a combination of any two wires in parallel connection with the first diode L1 and the second diode L2 and a combination of any two wires in parallel connection with the fifth diode L5 and the sixth diode L6; and a lighting manner of the six-path forward-reverse connection LED light string circuit is as follows:

when A− and B+, L2 lights, and when multiple paths of LED lamps are controlled, lamps in parallel connection with the controlled LED lamps in the same direction light;

when A+ and B−, L1 lights, and when multiple paths of LED lamps are controlled, lamps in parallel connection with the controlled LED lamps in the same direction light;

when A+ and C−, L3 lights, and when multiple paths of LED lamps are controlled, lamps in parallel connection with the controlled LED lamps in the same direction light;

when A− and C+, L4 lights, and when multiple paths of LED lamps are controlled, lamps in parallel connection with the controlled LED lamps in the same direction light;

when B− and C+, L5 lights, and when multiple paths of LED lamps are controlled, lamps in parallel connection with the controlled LED lamps in the same direction light; and when B+ and C−, L6 lights, and when multiple paths of LED lamps are controlled, lamps in parallel connection with the controlled LED lamps in the same direction light.

Furthermore, when sweep frequency in the embodiment is smaller than 24 Hz, the human eyes may recognize a changing procedure of the LED light string circuit; when the sweep frequency is larger than 24 Hz and the polarities of the port A, the port B and the port C are continuously changed, all LED lamps at the port A, the port B and the port C may be lighted at the same time, thereby achieving various gradually changing functions; and specific changing patterns are decided by demands.

Example of a Method

Figure 10:
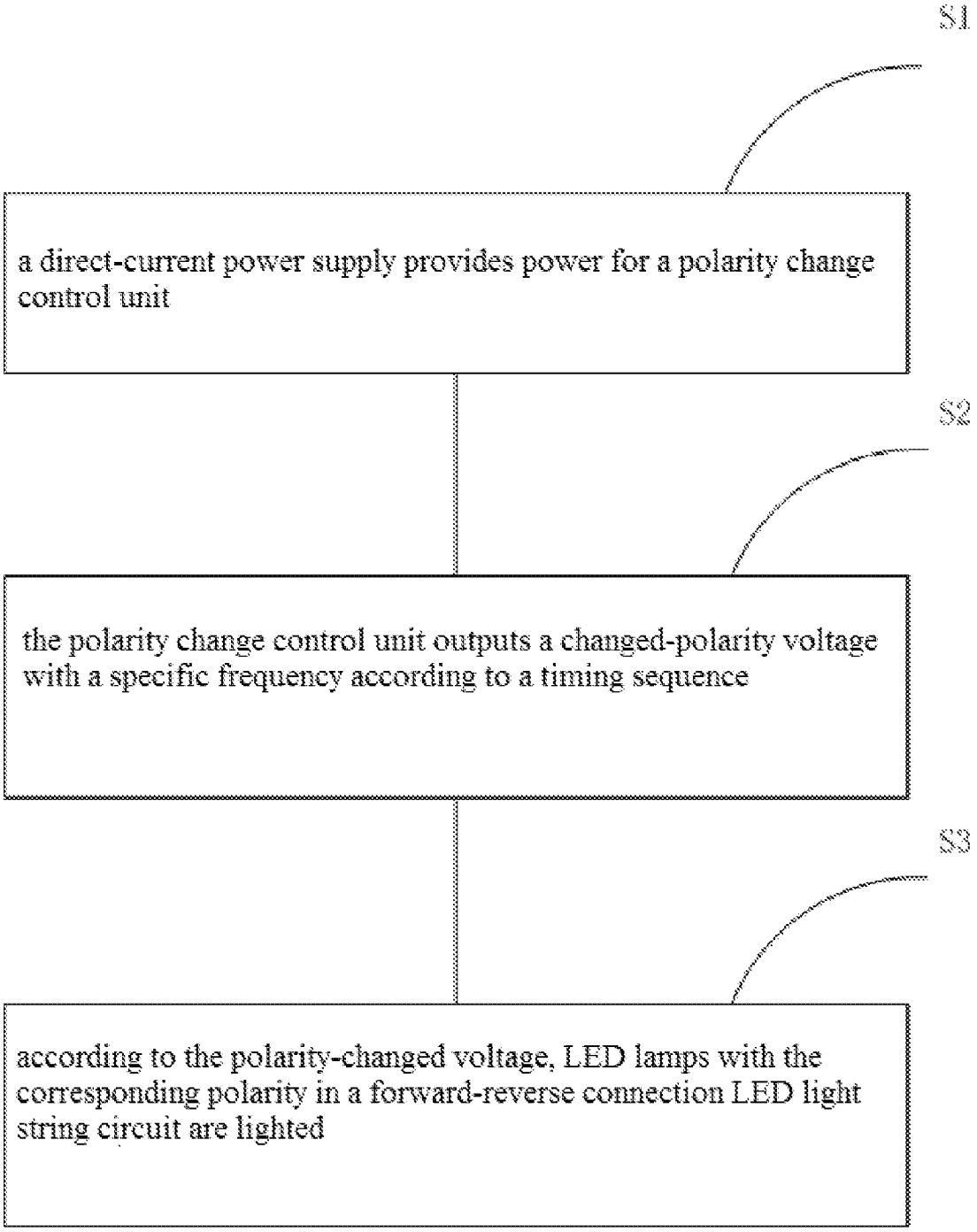
FIG. 10 is a flow schematic diagram of an embodiment of an LED light string control method provided by the present disclosure.
Figure 11:
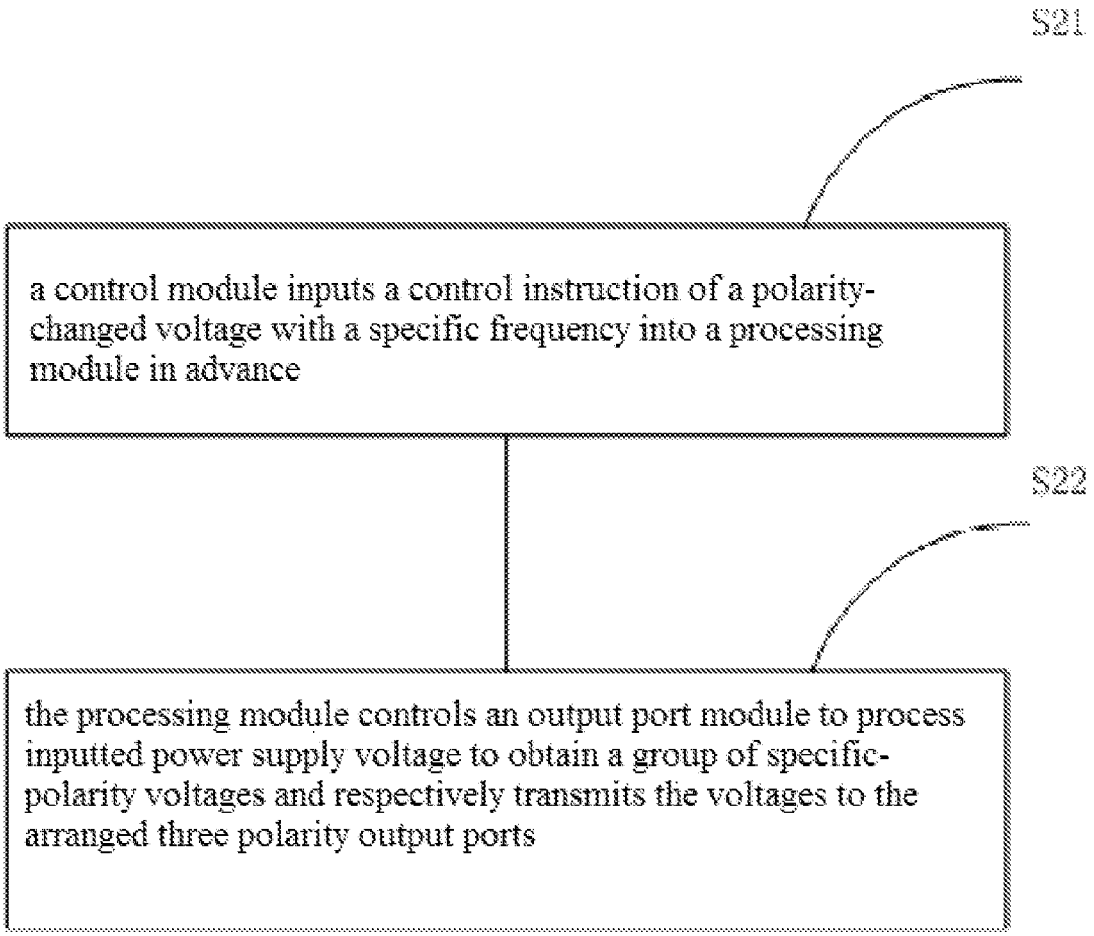
FIG. 11 is a flow schematic diagram of an embodiment of sub-steps of a step S2 in the LED light string control method provided by the present disclosure.

According to a second aspect, an LED light string control method is provided, as shown in FIG. 10 and FIG. 11, FIG. 10 is a flow schematic diagram of an embodiment of an LED light string control method provided by the present disclosure, and FIG. 11 is a flow schematic diagram of an embodiment of sub-steps of a step S2 in the LED light string control method provided by the present disclosure. The method comprises:

S1, a direct-current power supply 10 provides power for a polarity change control unit 20;

S2, the polarity change control unit 20 outputs a changed-polarity voltage with a specific frequency according to a timing sequence; and S3, according to the polarity-changed voltage, LED lamps with the corresponding polarity in a forward-reverse connection LED light string circuit are lighted.

The direct-current power supply 10 is used for providing direct-current voltage for the LED light string control system; and the polarity change control unit 20 is used for outputting the changed-polarity voltage with the specific frequency to the forward-reverse connection LED light string circuit according to the time sequence, so as to light LED lamps with the corresponding polarities in the forward-reverse connection LED light string circuit.

Furthermore, referring to FIG. 2, FIG. 2 is a schematic diagram of an embodiment of input port and output port connection in an embodiment of the LED light string control system provided by the present disclosure. The polarity change control unit 20 is a three-wire polarity change control unit 20, three output ports are arranged at the three-wire polarity change control unit 20 and respectively are a port a, a port b and a port c, the three output ports are respectively electrically connected with three input ports of the forward-reverse connection LED light string circuit, and the three input ports respectively are a first input port, a second input port and a third input port. It is supposed that the first input port, the second input port and the third input port respectively are a port A, a port B and a port C, and wires in the forward-reverse connection LED light string circuit corresponding to the ports respectively are a wire A, a wire B and a wire C.

The step S2 comprises: S21, a control module 21 inputs a control instruction of a polarity-changed voltage with a specific frequency into a processing module 22 in advance; and S22, the processing module 22 controls an output port module 23 to process inputted power supply voltage to obtain a group of specific-polarity voltages and respectively transmits the voltages to the arranged three output ports.

When the sweep frequency in the embodiment is smaller than 24 Hz, the human eyes may recognize a changing procedure of the LED light string circuit; when the sweep frequency is larger than 24 Hz and the polarities of the port A, the port B and the port C are continuously changed, all LED lamps at the port A, the port B and the port C may be lighted at the same time, thereby achieving various gradually changing functions; and specific changing patterns are decided by demands.

According to implementation of the LED light string control system and method provided by the present disclosure, the polarity change control unit 20 is configured, and the polarity change control unit 20 outputs the specific-changed-polarity voltage to the three-wire forward-reverse connection LED light string circuit according to the timing sequence instruction, so as to light LED lamps with the corresponding polarity; therefore, the traditional five-wire LED light string circuit may be replaced, and production costs are largely reduced; and when sweep frequency for the changed polarity according to the timing sequence is larger than 24 Hz, that is, LED lamps with all polarities are lighted at the same time, a decorative effect is achieved.

The embodiments of the present disclosure are described above in conjunction with accompanying drawings, but the present disclosure is not limited to the above specific implementation manners, and the above specific implementation manners merely are illustrative but not restrictive. These ordinarily skilled in the art may further make various forms under the enlightenment of the present disclosure without departing from the purposes of the present disclosure and the protection scope of the appended claims, and those forms all fall within the protection scope of the present disclosure.

What is claimed is:

1. An LED light string control system comprising a direct-current power supply, a polarity change control unit and a forward-reverse connection LED light string circuit, wherein the direct-current power supply is electrically connected with the polarity change control unit, and the polarity change control unit is electrically connected with the forward-reverse connection LED light string circuit;

the direct-current power supply is configured to provide direct-current voltage for the control system, the polarity change control unit is configured to output a changed-polarity voltage with a specific frequency to the forward-reverse connection LED light string circuit according to a timing sequence, wherein the polarity change control unit is a three-wire polarity change control unit.

2. The control system of claim 1, wherein three output ports are arranged at the three-wire polarity change control unit and are respectively electrically connected with three input ends of the forward-reverse connection LED light string circuit, and the three input ports are a first input port, a second input port and a third input port.

3. The control system of claim 2, wherein the three-wire polarity change control unit comprises a control module, a processing module, a power management module and an output port module, wherein the processing module is electrically connected with the control module, the power management module and the output port module at the same time, and the output port module is electrically connected with the three output ports of the three-wire polarity change control unit.

4. The control system of claim 1, wherein the forward-reverse connection LED light string circuit is one selected from the group consisting of three-path, four-path, five-path and six-path forward-reverse connection LED light string circuits, the three input ports of the forward-reverse connection LED light string circuit are a first input port, a second input port and a third input port, and corresponding wires of the three input ports respectively are a wire A, a wire B and a wire C.

5. The control system of claim 4, wherein the forward-reverse connection LED light string circuit comprises a first diode L1, a second diode L2 and a third diode L3, wherein the first diode L1 has a polarity opposite to that of the second diode L2, the first diode L1 and the second diode L2 are in parallel connection and connected between any two selected from the group consisting of the wire A, the wire B and the wire C, and any two wires in parallel connection with the third diode L3 have a combination different from that of any two wires in parallel connection with the first diode L1 and the second diode L2; or the forward-reverse connection LED light string circuit comprises a first diode L1, a second diode L2, a third diode L3 and a fourth diode L4, wherein the first diode L1 has a polarity opposite to that of the second diode L2, the third diode L3 has a polarity opposite to that of the fourth diode L4, the first diode L1 and the second diode L2 are in parallel connection and connected between any two selected from the group consisting of the wire A, the wire B and the wire C, and any two wires in parallel connection with the third diode L3 and the fourth diode L4 have a combination different from that of any two wires in parallel connection with the first diode L1 and the second diode L2; or the forward-reverse connection LED light string circuit comprises a first diode L1, a second diode L2, a third diode L3, a fourth diode L4 and a fifth diode L5, wherein the first diode L1 has a polarity opposite to that of the second diode L2, the third diode L3 has a polarity opposite to that of the fourth diode L4, the first diode L1 and the second diode L2 are in parallel connection and connected between any two selected from the group consisting of the wire A, the wire B and the wire C, and any two wires in parallel connection with the third diode L3 and the fourth diode L4 have a combination different from that of any two wires in parallel connection with the first diode L1 and the second diode L2 and that of any two wires in parallel connection with the fifth diode L5; or the forward-reverse connection LED light string circuit comprises a first diode L1, a second diode L2, a third diode L3, a fourth diode L4, a fifth diode L5 and a sixth diode L6, wherein the first diode L1 has a polarity opposite to that of the second diode L2, the third diode L3 has a polarity opposite to that of the fourth diode L4, the fifth diode L5 has a polarity opposite to that of the sixth diode L6, the first diode L1 and the second diode L2 are in parallel connection and connected between any two selected from the group consisting of the wire A, the wire B and the wire C, and any two wires in parallel connection with the third diode L3 and the fourth diode L4 have a combination different from that of any two wires in parallel connection with the first diode L1 and the second diode L2 and that of any two wires in parallel connection with the fifth diode L5 and the sixth diode L6.

6. The control system of claim 1, wherein the specific frequency is 24 Hz.

7. An LED light string control method comprising:

a polarity change control unit outputting a changed-polarity voltage with a specific frequency according to a timing sequence; and an LED lamp with the corresponding polarity in a forward-reverse connection LED light string circuit being lighted according to the polarity-changed voltage.

8. The LED light string control method of claim 7, wherein the polarity change control unit outputting a changed-polarity voltage with a specific frequency according to a timing sequence comprises:

a control module inputting a control instruction of a polarity-changed voltage with a specific frequency into a processing module in advance; and the processing module controlling an output port module to process inputted power supply voltage to obtain a group of specific-polarity voltages and respectively transmits the voltages to the arranged three output ports.

9. The LED light string control method of claim 7, wherein before the polarity change control unit outputting a changed-polarity voltage with a specific frequency according to a timing sequence, further comprises: a direct-current power supply providing power for the polarity change control unit.

10. The LED light string control method of claim 9, wherein the specific frequency is 24 Hz.

* * * * *